United States Patent [19]

Lowe

[11] Patent Number: 5,030,119

[45] Date of Patent: Jul. 9, 1991

[54] SAFETY PLUG

[75] Inventor: Thomas E. Lowe, Dundee, Ill.

[73] Assignee: Safe Care Products, Inc., Cassopolis, Mich.

[21] Appl. No.: 413,467

[22] Filed: Sep. 27, 1989

[51] Int. Cl.[5] ..... H01R 13/44

[52] U.S. Cl. ..... 439/141; 439/136

[58] Field of Search ..... 439/136, 140, 141, 149

[56] References Cited

U.S. PATENT DOCUMENTS

| | | | |
|---|---|---|---|
| 2,082,986 | 6/1937 | Staley | 439/140 |
| 2,396,901 | 3/1946 | Tiffany | 339/42 |
| 2,444,843 | 7/1948 | Modrey | 339/42 |
| 3,167,373 | 1/1965 | Kostich | 339/42 |
| 3,575,684 | 4/1971 | McIntyre | 339/42 |
| 3,754,205 | 8/1973 | Lenkey | 339/42 |
| 3,839,697 | 10/1974 | Obert | 339/42 |
| 4,203,640 | 5/1980 | Bice et al. | 339/42 |
| 4,340,267 | 7/1982 | Nukaga | 339/42 |
| 4,435,032 | 3/1984 | Abramson et al. | 439/136 |
| 4,445,739 | 5/1984 | Wooten | 439/140 |

FOREIGN PATENT DOCUMENTS

| | | |
|---|---|---|
| 660645 | 5/1938 | Fed. Rep. of Germany . |
| 802930 | 2/1951 | Fed. Rep. of Germany . |
| 169521 | 11/1951 | Fed. Rep. of Germany . |
| 412039 | 11/1966 | Fed. Rep. of Germany . |
| 930403 | 5/1964 | France . |
| 672031 | 10/1964 | Italy . |

*Primary Examiner*—Paula A. Bradley

*Attorney, Agent, or Firm*—Leydig, Voit & Mayer

[57] ABSTRACT

A safety electrical device, including a housing, a pair of electrical terminals projecting forwardly from said housing for insertion into an electrical receptacle, and a spring biased protective cover mounted on the housing for movement between an extended position enclosed in the forwardly projecting terminals within the cover when the terminals are not inserted in an electrical receptacle and a retracted position which permits the terminals to be inserted into the electrical receptacle. The housing includes a blade holder within which the terminals are fixed and a separate forward housing member secured in forwardly extending fashion to the blade holder. The housing is formed with outwardly extending forward flanges and a stepped outer peripery which facilitates gripping of the device and prevents the hand from slipping off the housing during insertion into and removal from an electrical receptacle. The protective cover has outer substantially uninterrupted surfaces which are adapted for smooth, reliable sliding contact with substantially uninterrupted internal surfaces of the forward housing member. The electrical device may be in the form of a card set plug or an electrical adapter.

24 Claims, 3 Drawing Sheets

SAFETY PLUG

DESCRIPTION OF THE INVENTION

The present invention relates generally to electrical plugs, and more particularly, to a safety electrical plug which has a terminal covering adapted to prevent the terminals of the plug from being inadvertently exposed as the plug is inserted into an electrical outlet to thereby protect the user against possible danger of electrical shock.

A variety of safety electrical plugs have been proposed which include various types of sleeves or covers that are extendable and retractable relative to the outwardly projecting terminals of the plug and which substantially encompass the outer ends of the terminals when the plug is not engaged in an electrical outlet or receptacle and which is automatically retractable to expose the plug terminals as the plug engages the receptacle. Many of these safety plugs have been complex in construction and operation and often have been difficult for the user to hold and manipulate into operative position into a wall receptacle, particularly when the receptacle is inconveniently located. Even with a protective covering or sleeve, it is possible for the user's hand to slip off the safety plug and engage the terminals or the live electrical outlet.

It is an object of the present invention to provide an improved safety electrical plug with automatic terminal blade covering means which is relatively simple in construction and operation. A related object is to provide a similar adapter for electrical plugs.

Another object is to provide a safety electrical plug and adapter as characterized as above in which a protective sleeve or cover is reliably and smoothly movable between extended and retracted positions.

A further object is to provide a safety plug and adapter of the above kind which is adapted to prevent accidental slippage of the user's hand off the device during insertion into and removal from an electrical receptacle.

Another object is provide a safety plug and adapter of the foregoing type which lends itself to efficient manufacture.

Other objects and advantages of the invention will become apparent upon reading the following detailed description when taken into conjunction with the accompanying drawings, in which.

Figure 1:
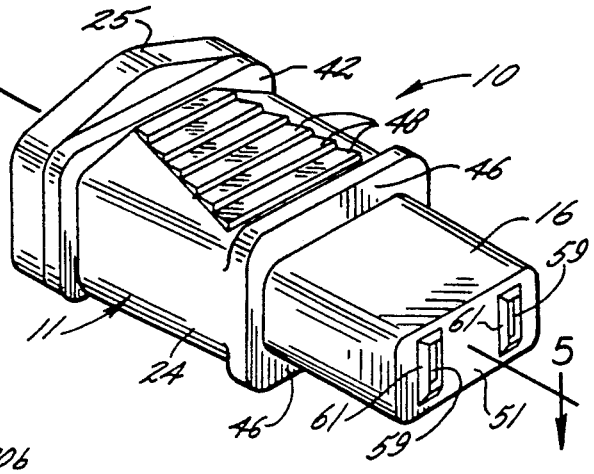
FIG. 1 is a perspective of an illustrative electrical safety plug adapter embodying the present invention.
Figure 2:
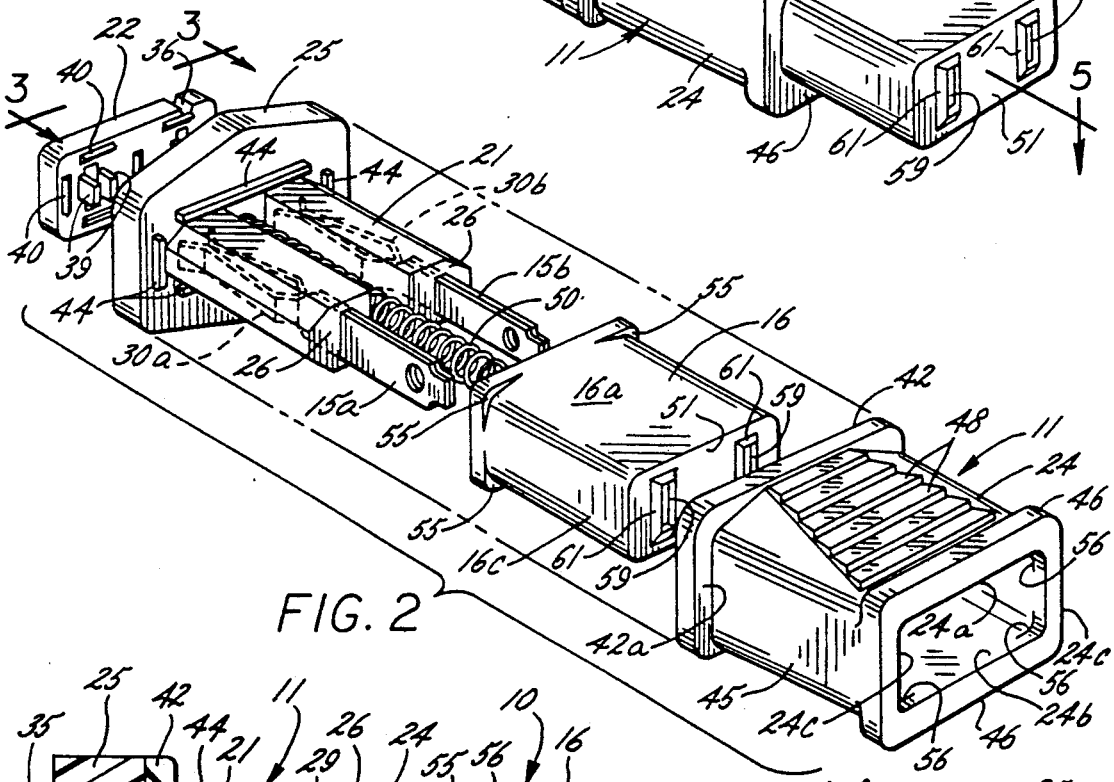
FIG. 2 is an exploded perspective of the component parts of the safety plug adapter shown in FIG. 1.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Figure 5:
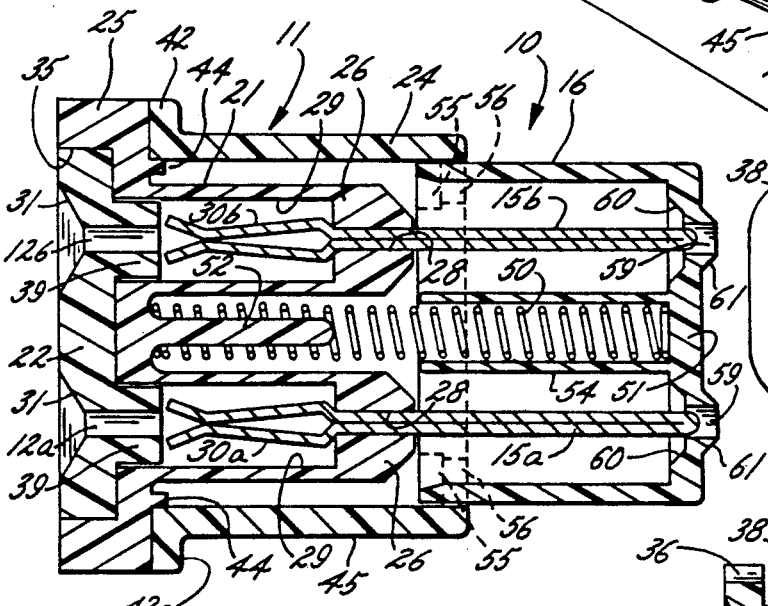
FIG. 5 is an enlarged, horizontal section taken in the plane of line 5—5 in FIG. 1, showing the protective cover of the device in an extended terminal protecting position.
Figure 3:
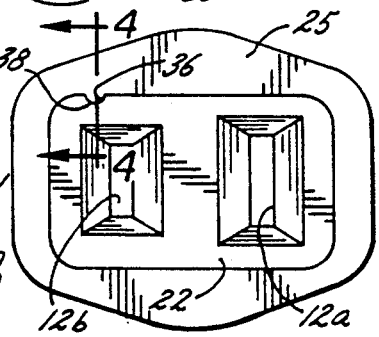
FIG. 3 is an enlarged end view of the illustrated safety plug adapter, taken in the plane of line 3—3 in FIG. 2.
Figure 4:
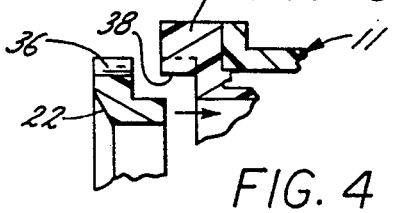
FIG. 4 is an exploded fragmentary section of the safety plug adapter, taken in the plane of line 4—4 in FIG. 3.

Referring now more particularly to FIGS. 1-9 of the drawings, there is shown an illustrative safety plug adapter 10 embodying the present invention. The safety plug adapter 10 basically comprises a housing 11 having a pair of rearwardly facing sockets 12*a*, 12*b* for receiving the terminals of a plug with which the adapter 10 is to be used and a pair of forwardly extending terminals 15*a*, 15for insertion into an electrical receptacle or outlet. A protective cover 16 is positioned over the forwardly extending ends of the terminals 15*a*, 15*b* for movement between a terminal protecting position, as is shown in FIG. 5, and a retracted terminal exposed position, shown in FIG. 6, as the adapter terminals engage an electrical receptacle. The housing 11 and protective cover 16 are made of suitable diaelectrical material, such as plastic. It will be understood that while a two terminal safety plug adapter has been illustrated, the invention is equally applicable to three terminal electrical adapters and plugs.

In accordance with one aspect of the invention, the safety plug adapter housing 11 has a three part construction which lends itself to economical manufacture and results in a relatively streamlined, safely to use profile. The safety plug adapter housing 11 comprises a terminal blade holder 21, a separate rear entry plate 22, and a forward housing member 24. The blade holder 21 has a base 25 with a pair of forwardly extending terminal blade holding arms 26 each supporting a respective one of the terminals 15*a*, 15*b*. The terminals 15*a*, 15*b* preferably are of a folded blade-type construction, each having a central portion securely held in a slit-like opening 28 in forward end of a respective blade holding arm 26. The terminal blades 15*a*, 15*b* each have a front end extending forwardly of its respective blade holding arm 26 and a rearward forked end 30*a*, 30*b* disposed in a rearwardly opening socket chamber 29 in the arm 26.

The terminals 15*a*, 15*b* preferably are made of spring steel and are adapted to frictionally grip male terminals of an electrically plug inserted into the sockets 12*a*, 12*b* of the adapter 10. The rearward forked terminal ends 30*a*, 30*b* in this instance are outwardly flared to facilitate receiving the male terminals inserted into the adapter and foceably separating the opposed sides of the terminal ends. The forked ends 30*a*, 30*b* of the terminals 15*a*, 15*b* preferably are inwardly biased with respect to each other for making reliable electrical contact with the plug terminals. The terminal receiving sockets 12*a*, 12*b* in this case also each have tapered entrances ramps 31 to facilitate insertion of the male plug terminals through the sockets 12*a*, 12*b* and into contact with the adapter terminals 15*a*, 15*b*. One of the terminals 15*a* in this case is intended as a polarized terminal, being of larger size than the other terminal 15*b*, and the entry plate sockets 12*a*, 12*b* are similarly sized for receiving a plug with a polarized terminal.

For enclosing the rear of the blade holder 21 following assembly of the terminals 15*a*, 15*b* therein, the rear entry plate 22 is positional into a rearwardly facing recess 35 in the blade holder base 25. The entry plate 22 in this instance is positioned in the recess 35 with a rear face thereof flush with the rear face of the blade holder base 25.

To facilitate proper alignment of the sockets 12*a*, 12*b* formed in the rear entry plate 22 with the respective terminals 15*a*, 15*b*, the entry plate 22 and blade holder 21 are formed with locating notches and lugs adapted for interfitting relation. In the illustrated embodiment, the upper side of the entry plate 22 is formed with a notch 36 which receives a locating lug 38 formed in the blade holder 21 on a top wall of the recess 35. When the rear entry plate 22 is positioned into the recess 35 of the blade holder 21 with the locating lug 38 of the blade holder located in the recess 36 of the entry plate 22, the enlarged socket 12*a* is automatically located with the polarized terminal 15*a* and the smaller socket 12*b* is automatically aligned with the other terminal 15*b*.

To insure proper central positioning of the rear entry plate 22 into the recess 35 of the blade holder 21, entry plate 22 in the illustrated embodiment is formed with forwardly projecting locating lugs 39 on opposite sides of each socket 12*a*, 12*b* that are positionable into closly adjacent relation with the opposite side walls of the socket chambers 29 in the blade holder 21. For securing the rear entry blade 22 to the blade holder 21 when properly positioned and aligned in the rear recess 35 of the blade holder, a forward face of the rear entry plate 22 is formed with relatively narrow, forwardly pointed ridges 40 (FIG. 2) which are positionable against a bottom wall of the recess 35 of the blade holder. Such ridges 40 facilitate bonding of the rear entry plate 22 to the blade holder 21 by conventional sonic welding techniques.

For completing the housing 11, the forward housing member 24 has a rear base plate 42 that is positioned adjacent a forward face of the blade holder base 25 for securement by sonic welding. Prior to securing the forward housing member 24 to the blade holder 21, the safety cover 16 is telescoped over the terminals 15*a*, 15*b* and the blade holder arms 26. For properly locating the forward housing member 24 on the base 25 of the blade holder 21 and to prevent relative movement therebetween during welding, the forward face of the blade holder base 25 has a plurality of horizontal and vertical locating ridges 44 formed in a generally rectangular array, which are positionable into close fitting relation to the internal walls of the rectangular configured rear opening in forward housing member 24.

In keeping with the invention, the forward housing member 24 has a streamlined, safely to use profile which tends to prevent the user's hands from slipping off of the adapter when handling and positioning into an electrical receptacle. The forward housing member 24 in this case has a rear peripheral flange 42*a* defined by the base 42 and a smaller sized forwardly extending hollow portion 45 (FIG. 2) of generally rectangular cross-section which terminates in forwardmost upper and lower horizontal flanges 46 extending beyond the top and bottom peripheries of the rectangular section 45. A plurality of stepped ledges 48 extend forwardly and inwardly from the rear flange 42*a* to the forward flanges 46 on the top and bottom sides of the forward housing member 24. The ledges 48, together with the outstanding flanges 42*a*, 46, enhance reliable gripping of the adapter 10 and prevent slippage in the hand of the user off the ends thereof.

For biasing the protective cover 16 toward its outer terminal protecting position, shown in FIG. 5, a coil spring 50 is interposed between a forward face of the blade holder 21 and an end wall 51 of the protective cover 16. For retaining the coil spring 50 in centrally located position on the blade holder 21, the blade holder 21 is formed with a forwardly extending post 52 over which a rear end portion of the spring 50 is disposed. For retaining the forward end portion of the spring 50 and for preventing accidental contact of the spring 50 with the forwardly projecting ends of the terminals 15*a*, 15*b* when the cover 16 is in an extended position, the end wall 51 of the protective cover 16 is formed with a rearwardly projecting cylindrical sleeve 54 extending the length of the protective cover 16 within which the forward portion of the spring is contained.

To facilitate smooth and easy movement of the protective cover 16 between its extended and retracted positions, the protective cover 16 has substantially uninterrupted outer top, bottom, and side surfaces 16*a*, 16*b*, 16*c*, respectively extending the length thereof. The forward housing member 24 is formed with similar substantially uninterrupted internal top, bottom, and side walls 24*a*, 24*b*, 24*c*, respectively, for cooperative sliding engagement with the surfaces 16*a*, 16*b*, 16*c* of the protective cover 16. The relatively large surface area contact between the protective cover 16 and housing member 24 enables smooth guided movement of the cover 16 relative to the housing member 24 without binding or substantial tilting of the protective cover relative to the housing member.

Figure 6:
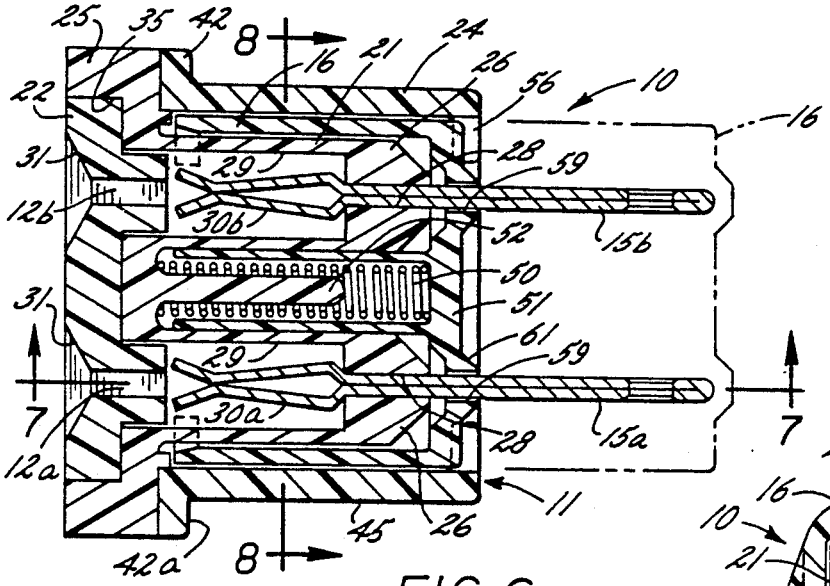
FIG. 6 is a section similar to FIG. 5, but showing the protective cover in a retracted position.
Figure 7:
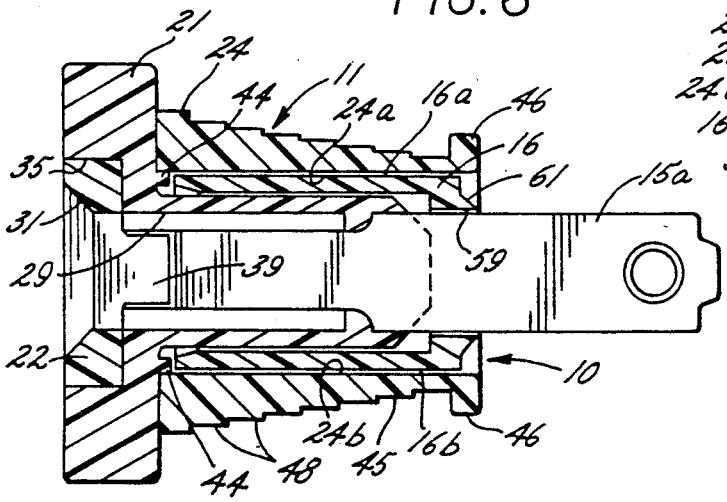
FIG. 7 is a longitudinal vertical section taken in the plane of line 7—7 in FIG. 6.
Figure 8:
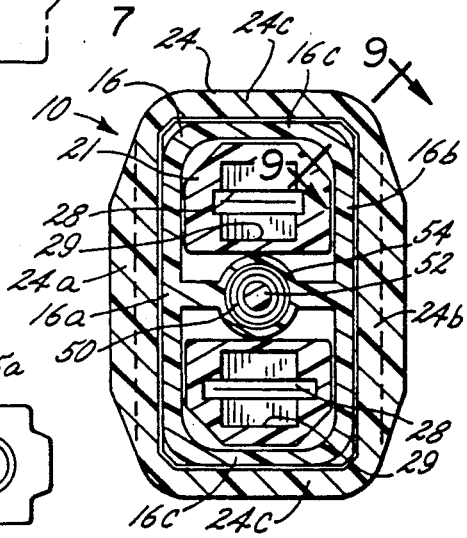
FIG. 8 is a transverse vertical section taken in the plane of line 8—8 in FIG. 6.
Figure 9:
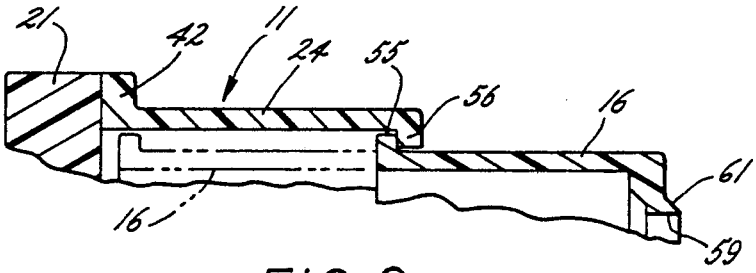
FIG. 9 is a fragmentary section taken in the plane of line 9—9 in FIG. 8.

For limiting movement of the protective cover 16 relative to the forward housing member 24, the protective cover has flanged rear corners 55 extending outwardly from the periphery of the top, bottom, and side surfaces, 16*a*, 16*b*, 16*c*, respectively, of the protective cover, and the forward flanges 46 of the housing member 24 have inwardly extending rounded corners 56, the rear sides of which define stop surfaces against which the corners 55 of the protective cover 16 engage when the protective cover 16 reaches a forward most position completely encompassing the terminals 15*a*, 15*b* upon withdrawal of the adapter 10 from an electrical outlet or receptacle (FIGS. 5 and 9). Rearward or retracted movement of the protective cover 16 is limited by a rear face of the protective cover engaging the forward face of the blade holder base 25 (FIGS. 6 and 7).

The forward end 51 of the protective cover 16, while substantially enclosing the front of the protective cover, is formed with a pair of slit-like openings 59 that allow free movement of the cover 16 relative to terminals 15*a*, 15*b*. To facilitate entry of the terminals 15*a*, 15*b* through the slit-like openings 59, the end wall 51 of the protective cover is formed with forwardly tapered entry ramps 60 adjacent the slit-like openings 59 (FIG. 5). The outer side of the end wall 51 is formed with similar forwardly tapered ramps or projections 61 adjacent the terminal receiving openings 59 to enable proper positioning of the adapter 10 relative to an electrical outlet receptacle when the protective cover 16 is in an extended terminal protecting position, prior to insertion of the adapter terminals into the electrical receptacle.

In use of the adapter 10, it will be understood that the male terminals of a plug with which the adapter is to be used are first fully inserted into the sockets 12*a*, 12*b* of the adapter for making electrical contact with the forked ends 30*a*, 30*b* of the adapter terminals 15*a*, 15*b*. When the adapter is not operatively connected to an electrical receptacle, the forwardly extending ends of terminals 15*a*, 15*b* are fully enclosed within the protective cover 16 so that they cannot be bridged by fingers of the user. As the forwardly projecting ramps 61 adjacent the protective covering openings 59 are positioned for seated engagement adjacent the socket openings of electrical receptacle, the terminals 15*a*, 15*b* are automatically aligned with the socket openings of the receptacle. Forward movement of the adapter 10 will thereupon move the adapter terminals 15*a*, 15*b* into engagement with the receptacle, while the protective cover 16 is simultaneously moved toward its retracted position in smooth fashion, guided by the cooperating surfaces of the internal walls 24*a*, 24*b*, 24*c* of the forward housing member 24 and the external surfaces 16*a*, 16*b*, 16*c* of the protective cover. Upon withdrawal of the adapter 10 from the electrical receptacle, the protective cover 16 automatically returns to its extended terminal protecting position under the biassing force of the spring 50.

Figure 10:
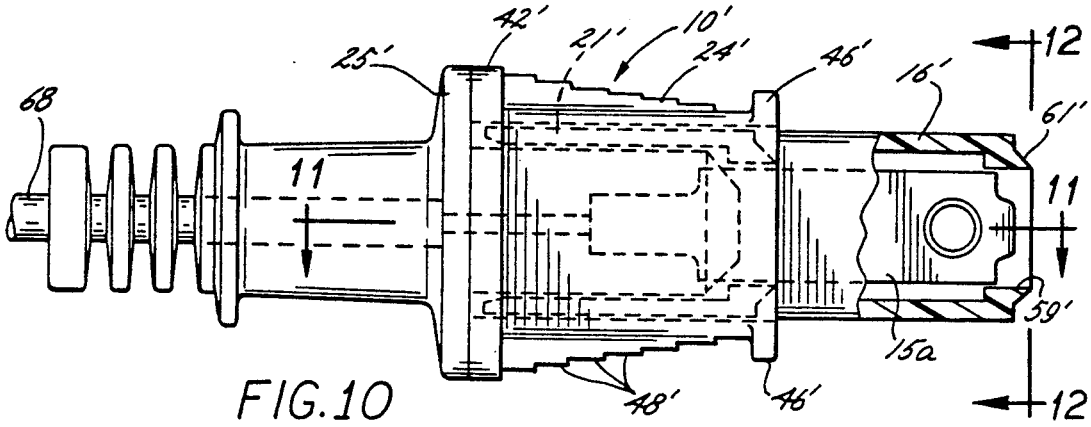
FIG. 10 is a side elevational view of a cord set or extension cord safety plug embodying the present invention.
Figure 11:
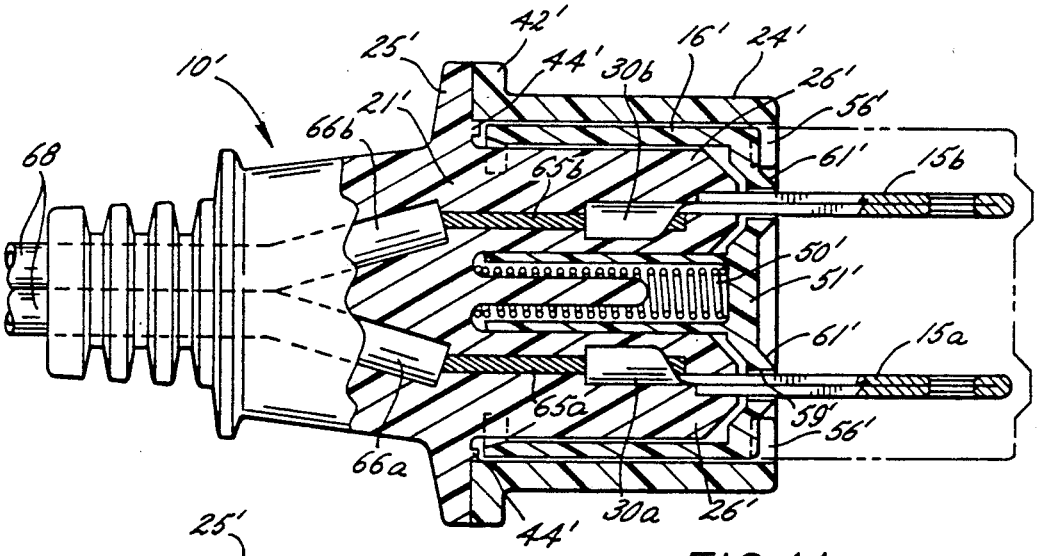
FIG. 11 is a horizontal, fragmentary section taken in the plane of line 11—11 in FIG. 10.
Figure 12:
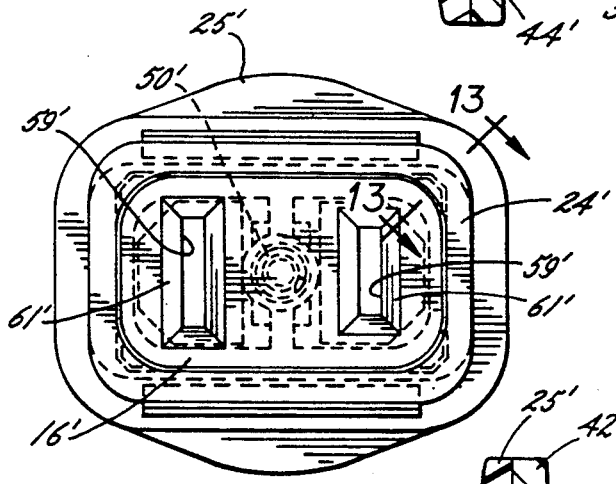
FIG. 12 is an end view taken in the plane of line 12—12 in FIG. 10
Figure 13:
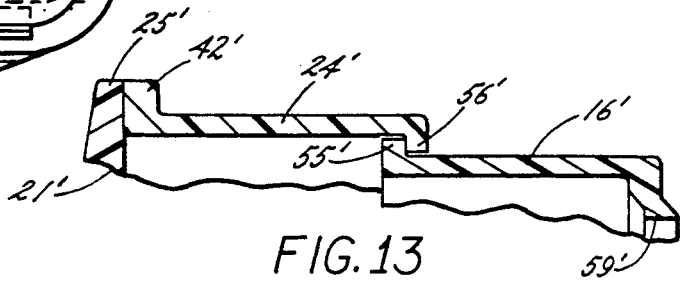
FIG. 13 is a fragmentary section taken in the plane of line 13—13 in FIG. 12.

Referring now to FIGS. 10–12 of the drawings, there is shown an alternative embodiment of the invention which is in the form of a cord set or extension cord plug 10', wherein items similar to those described above have been given similar reference terminals with the distinguishing "'" added. The electrical plug 10' in this case has a terminal blade holder 21', a forward housing member 24', and an extensible and retractable protective cover 16'. The blade holder 21' has a pair of forwardly extending arms 26' which each secure a respective folded blade type terminal 15*a'*, 15*b'* with a forwardly extending end projecting from the blade holder and a rearwardly extending end 30*a'*, 30*b'* within the holder. The rearward ends 30*a'*, 30*b'* of the terminals in this instance are crimpped or welded to respective conductors 65*a*, 65*b*, preferrably molded within the blade holder 21', and which extend rearwardly of the terminals 15*a'*, 15*b'* through insulating sleeves 66*a*, 66*b* of an electrical cord 68 or the like. The forward housing member 24' is connected to a forward face of a radial flange 25' of the blade holder 21' in a manner similar to that previously described, with locating lugs 44' positioned in close relation to internal walls of the forward housing member 24'. The forward housing member 24' and the protective cover 16' are identical to that previously described. Hence, the protective cover 16' similarly is operable for protecting and covering the terminals 15*a'*, 15*b'* when the plug 10' is being inserted into and removed from an electrical receptacle.

From the foregoing, it can be seen that the protective cover for the electrical plug or adapter is both relatively simple in construction and is adapted for reliable guided movement between extended and retracted positions. The forward housing member is adapted to prevent accidental slippage of the user's hand off the adapter or plug during insertion into and removal from the electrical receptacle. The component parts of the plug and adapter may be inexpensively formed of plastic and lend themselves to a relatively efficient assembly.

I claim:

1. A safety electrical device comprising a housing, a pair of electrical terminals projecting forwardly from one end of said housings for insertion into and removal from an electrical receptacle, a protective cover mounted on said housing for free movement between an extended position enclosing said forwardly projecting terminals within said cover when the terminals are not inserted in an electrical receptacle and a retracted position which permits said terminals to be inserted in the electrical receptacle while hand gripping said housing, means interposed between said housing and protective cover for biasing said cover toward said extended position, said housing having top and bottom sides that extend in forwardly and inwardly tapered relation to each other and which each terminate in an outwardly projecting flange, and said top and bottom housing sides being formed with stepped ledges which together with said outwardly projecting flanges facilitate hand gripping of said device and prevent the hand from slipping off a forward end of said housing during insertion into and removal from an electrical receptacle.

2. The electrical safety device of claim 1 in which said protective cover has outer substantially uninterrupted top, bottom and side surfaces adapted for sliding contact with internal substantially uninterrupted top, bottom and side walls of said housing.

3. A safety electrical device comprising a housing, a pair of electrical terminals projecting forwardly from one end of said housing for insertion into and removal from an electrical receptacle, said housing including a blade holder within which said terminals are fixed and a separate forward housing member secured in forwardly extending fashion to said blade holder, a protective cover mounted on said housing for movement between an extended position enclosing said forwardly projecting terminals within said cover when the terminals are not inserted in an electrical receptacle and a retracted position which permits said terminals to be inserted in the electrical receptacle, means interposed between said housing and protective cover for biasing said cover toward said extended position, and said forward housing member being formed with outwardly extending flanges on top and bottom sides thereof adjacent a forward end thereof and forwardly and inwardly stepped ledges extending between a rear end of said housing and said flanges for facilitating hand gripping of said device and for preventing the hand from slipping off said housing during insertion into and removal from an electrical receptacle.

4. The electrical safety device of claim 3 in which said biasing means is a coil spring, said blade holder being formed with a forwardly projecting spring retaining post over which a rear portion of said spring is disposed and said protective cover being formed with a rearwardly extending sleeve which extends the length of said protective cover and within which a forward end portion of said spring is disposed.

5. The electrical safety device of claim 3 in which said safety device is an electrical plug adapter, said terminals having rearwardly projecting ends, and said housing being formed with a pair of socket openings for permitting insertion of male terminals of an electrical plug into said adapter for making electrical contact with rearwardly projecting terminal ends.

6. The electrical safety device of claim 5 in which said blade holder is formed with rearwardly facing socket chambers communicating with said housing socket openings within which said rearwardly projecting terminal ends are disposed.

7. The electrical safety device of claim 6 in which said terminals have inwardly biased yoke-shaped rearwardly projecting terminal ends for positively gripping the male terminals of an electrical plug inserted into said socket openings.

8. The electrical safety device of claim 7 in which said housing includes a rear entry plate formed with said socket openings, said rear entry plate being secured to a rear side of said blade holder.

9. The electrical safety device of claim 8 in which said blade holder is formed with a rearwardly facing recess, and said rear entry plate is secured within said recess with a rear face thereof in substantially coplanar relation to a rearwardmost end of said blade holder.

10. The electrical safety device of claim 8 in which said rear entry plate has forwardly extending locating lugs for positioning in closely adjacent relation within said socket chambers of said blade holder for locating the rear entry plate in predetermined relation thereto.

11. The electrical safety device of claim 10 in which said blade holder has forwardly directed locating flanges for positioning in closely adjacent relation to internal walls of said forward housing member for properly positioning said forward housing member on said blade holder.

12. A safety electrical device comprising a housing, a pair of electrical terminals projecting forwardly from one end of said housing for insertion into and removal from an electrical receptacle, a protective cover mounted on said housing for movement between an extended position enclosing said forwardly projecting terminals within said cover when the terminals are not inserted in an electrical receptacle and a retracted position which permits said terminals to be inserted in the electrical receptacle, means interposed between said housing and protective cover for biasing said cover toward said extended position, said protective cover having outer substantially uninterrupted top, bottom and side surfaces adapted for sliding contact with internal substantially uninterrupted top, bottom and side walls of said housing, and means for limiting movement of said protective cover between said extended and retracted positions, said movement limiting means including flanges extending outwardly from a rear end of said protective cover at corners defined by said top, bottom and side protective cover surfaces, and flanges extending inwardly from the forward end of said housing at corners defined by said top, bottom, and side housing surfaces which form stop surfaces for engagement by said protective cover corner flanges.

13. A safety electrical device comprising a housing, a pair of electrical terminals projecting forwardly from one end of said housing for insertion into and removal from an electrical receptacle, a protective cover mounted on said housing for movement between an extended position enclosing said forwardly projecting terminals within said cover when the terminals are not inserted in an electrical receptacle and a retracted position which permits said terminals to be inserted in the electrical receptacle, means interposed between said housing and protective cover for biasing said cover toward said extended position, means for limiting movement of said protective cover between said extended and retracted positions, said movement limiting means including flanges extending outwardly from a rear end of said protective cover at the corners thereof and flanges extending inwardly from the forward end of said housing of the corners thereof for defining stop surfaces for engagement by said protective cover corner flanges, and said housing being formed with outwardly extending flanges on top and bottom sides thereof adjacent a forward end thereof and forwardly and inwardly stepped ledges extending between a rear end of said housing and said flanges for facilitating hand gripping of said device and for preventing the hand from slipping off said housing during insertion into and removal from an electrical receptacle.

14. A safety electrical adapter comprising a housing, a pair of electrical terminals fixed in said housing and having forwardly projecting ends for insertion into and removal from an electrical receptacle, said terminals having rearwardly projecting ends, a protective cover mounted on said housing for movement between an extended position enclosing said forwardly projecting terminal ends within said cover when not inserted in an electrical receptacle and a retracted position which permits said forwardly projecting terminal ends to be inserted in the electrical receptacle, means interposed between said housing and protective cover for biasing said cover toward said extended position, and said housing including a blade holder within which said terminals are fixed, a separate forward housing member secured in forwardly extending fashion to said blade holder, and a separate rear entry plate secured to the rear side of said blade holder, said rear entry plate being formed with socket openings for permitting insertion of male terminals of an electrical plug into said adapter for making electrical contact with said rearwardly projecting terminal ends.

15. The safety electrical adapter of claim 14 in which said blade holder is formed with rearwardly facing socket chambers communicating with said rear entry plate socket openings within which said rearwardly projecting terminal ends are disposed.

16. The safety electrical adapter of claim 15 in which said rearwardly projecting terminal ends have inwardly biased yoke-shaped sides for positively gripping the male terminals of an electrical plug inserted into said socket openings.

17. The safety electrical adapter of claim 15 in which said blade holder is formed with a rearwardly facing recess, and said rear entry plate is secured within said recess with a rear face thereof in substantially coplanar relation to a rearwardmost end of said blade holder.

18. The safety electrical adapter of claim 15 in which said rear entry plate has forwardly extending locating lugs for positioning in closely adjacent relation within said socket chambers of said blade holder for locating the rear entry plate in predetermined relation thereto.

19. The safety electrical adapter of claim 14 including means for limiting movement of said protective cover between said extended and retracted positions, said movement limiting means including corner flanges extending outwardly from a rear end of said protective cover and corner flanges extending inwardly from the forward end of said forward housing member for defining stop surfaces for engagement by said protective cover corners.

20. The safety electrical adapter of claim 19 in which said protective cover has outer substantially uninterrupted top, bottom and said surfaces adapted for sliding contact with internal substantially uninterrupted top, bottom and side walls of said forward housing member.

21. A safety electrical device comprising a housing, a pair of electrical terminals projecting forwardly from one end of said housing for insertion into and removal from an electrical receptacle, a protective cover mounted on said housing for movement between an extended position enclosing said forwardly projecting terminals within said cover when the terminals are not inserted in an electrical receptacle and a retracted position which permits said terminals to be inserted in the electrical receptacle, means interposed between said housing and protective cover for biasing said cover toward said extended position, said protection cover having outer substantially uninterrupted top, bottom and side surfaces adapted for sliding contact with internal substantially uninterrupted top, bottom and side walls of said forward housing member, means for limiting movement of said protective cover between said extended and retracted positions, said movement limiting means including flanges extending outwardly from a rear end of said protective cover at corners from a rear end of said protective cover at corners defined by said top, bottom and side protective cover surfaces and flanges extending inwardly from the forward end of said housing member of the corners thereof for defining stop surfaces for engagement by said protective cover corners, and said housing being formed with outwardly extending flanges on top and bottom sides thereof adjacent a forward end thereof and forwardly and inwardly stepped ledges extending between a rear end of said housing and said flanges for facilitating hand gripping of said device and for preventing the hand from slipping off said housing during insertion into and removal from an electrical receptacle.

22. A safety electrical device comprising a housing, a pair of electrical terminals projecting forwardly from one end of said housing for insertion into and removal from an electrical receptacle said housing comprising a blade holder within which said terminals are fixed and a separate forward housing member secured in forwardly extending fashion to said blade holder, a protective cover mounted on said housing for movement between an extended position enclosing said forwardly projecting terminals within said cover when the terminals are not inserted in an electrical receptacle and a retracted position which permits said terminals to be inserted in the electrical receptacle, means interposed between said housing and protective cover for biasing said cover toward said extended position, said protective cover having outer substantially uninterrupted top, bottom and side surfaces adapted for sliding contact with internal substantially uninterrupted top, bottom and side walls of said housing, and means for limiting movement of said protective cover between said extended and retracted positions, said movement limiting means including corner flanges extending outwardly from a rear end of said protective cover and corner flanges extending inwardly from the forward end of said housing for defining stop surfaces for engagement by said protective cover corners.

23. The electrical safety device of claim 22 in which said safety device is an electrical plug adapter, said terminals having rearwardly projecting ends, and said housing being formed with a pair of sockets for permitting insertion of male terminals of an electrical plug into said adapter for making electrical contact with rearwardly projecting terminals ends.

24. The electrical safety device of claim 23 in which said blade holder is formed with rearwardly facing socket chambers communicating with said housing sockets within which said rearwardly projecting terminal ends are disposed.

* * * * *